US006387192B1

(12) United States Patent
Frommeyer et al.

(10) Patent No.: US 6,387,192 B1
(45) Date of Patent: May 14, 2002

(54) LIGHT CONSTRUCTIONAL STEEL AND THE USE THEREOF

(76) Inventors: Georg Frommeyer, Carl-Zuckmeyer-Strasse 38, 40699 Erkrath; Oliver Grässel, Kaufmannstrasse 234, 4700 Krefeld, both of (DE)

( * ) Notice: Subject to any disclaimer, the term of this patent is extended or adjusted under 35 U.S.C. 154(b) by 0 days.

(21) Appl. No.: 09/462,042

(22) PCT Filed: Jul. 1, 1998

(86) PCT No.: PCT/EP98/04044

§ 371 Date: Dec. 29, 1999

§ 102(e) Date: Dec. 29, 1999

(87) PCT Pub. No.: WO99/01585

PCT Pub. Date: Jan. 14, 1999

(30) Foreign Application Priority Data

Jul. 1, 1997 (DE) ..... 197 27 759

(51) Int. Cl.[7] ..... C22C 38/04; C22C 38/02; C22C 38/06

(52) U.S. Cl. ..... 148/329; 420/70

(58) Field of Search ..... 420/72; 148/329

(56) References Cited

U.S. PATENT DOCUMENTS 2,329,186 A 9/1943 Dean et al.

5,348,701 A 9/1994 Ohdake et al.

FOREIGN PATENT DOCUMENTS

| | | | | |
|---|---|---|---|---|
| JP | 52-36513 | * 3/1977 | ..... | 420/72 |
| JP | 472570 | * 6/1982 | ..... | 420/72 |
| JP | 1079689 | * 3/1984 | ..... | 420/72 |
| JP | 60-248866 | * 12/1985 | ..... | 420/72 |
| JP | 04 083852 | 3/1992 | | |
| JP | 5-117812 | 5/1993 | | |
| WO | WO 93/13233 | 7/1993 | | |

OTHER PUBLICATIONS

"New Stainless Steel Without Nickel or Chronium for Marine Applications," Rosie Wang et al., *Metal Progress*, vol. 123, No. 4, Mar. 1993, pp. 72–76.

"Phase Transformations and Mechanical Properties of Fe–Mn–Si–Al TRIP–Steels," O. Grässel et al., *J. Phys. IV*, vol. 7, No. C5, Nov. 1997, pp. 383–388.

* cited by examiner

*Primary Examiner*—Deborah Yee
(74) *Attorney, Agent, or Firm*—Proskauer Rose LLP

(57) ABSTRACT

The invention relates to an easily cold-workable, in particular easily deep-drawable ultra high strength austenitic light-weight construction steel with an ultimate tensile strength of up to 1100 MPa and with TRIP and TWIP characteristics, as well as its use for motor vehicle body sheetmetal components, structural components used for stiffening, as well as cryogenic containers and pipelines.

6 Claims, No Drawings

LIGHT CONSTRUCTIONAL STEEL AND THE USE THEREOF

The invention relates to a lightweight construction steel and its use.

It is the object of the invention to create an easily cold-workable, in particular easily deep-drawable lightweight construction steel with an ultimate tensile strength of up to 1100 MPa and with TRIP and TWIP characteristics, said steel being alloyed with economical elements and thus being cost-effective to produce.

According to the invention, this object is met by an austenitic steel which is characterised by the following chemical composition (in mass %):

1 to 6% Si 1 to 8% Al with (Al+Si)≦12%, 10 to 30% Mn, the remainder being iron, including the usual elements accompanying steel.

Preferably this lightweight construction steel contains 2 to 4% each of Si and Al as well as 24 to 26% Mn, with the remainder essentially being iron.

Such steels are characterised by increased yield stresses of 400 MPa which due to the high work-hardening rate comprise tensile strength values of up to 1100 MPa and achieve uniform elongation values of up to 70% as well as maximum elongations of up to 90%.

A steel within the alloy regions according to the invention, containing 3% Si and Al each, as well as 25% Mn, with the remainder being Fe, said steel comprising an austenitic microstructure and TRIP (Transformation Induced Plasticity) and TWIP (Twinning Induced Plasticity) characteristics, at temperatures below −150° C. achieves elongation values of up to 65% at an energy consumption rate remaining nearly constant at 0.5 $J.mm^{-3}$ compared with 0.2 $J.mm^{-3}$ of known higher-strength deep drawing grades. The high values of energy absorption—dissipative energy—of 0.5 $J.mm^{-3}$ are based on the deformation-induced martensitic phase transformation and the intensive twinning in the austenite phase. These, as well as the mechanical characteristics, remain intact even at extremely high deformation rates of up to $10^3$ $s^{-1}$. The excellent plasticity of the TRIP and TWIP steels according to the invention is maintained down to low temperatures.

Furthermore, due to the alloy elements Al, Si and Mn, the steel according to the invention achieves a reduced density down to 7 $g/cm^3$ .

Due to the spectrum of characteristics described, the steels according to the invention as hot-rolled or, if applicable, cold-rolled sheets are used to advantage not only for crash-stable motor vehicle body structures but also in cryogenic technology for containers and/or pipelines.

What is claimed is:

1. Motor vehicle body sheetmetal components and structural body components used for stiffening made from an easily deep-drawable austenitic lightweight construction steel with an ultimate tensile strength of 1100 MPa and with TRIP and TWIP characteristics, made from an alloy consisting of (in mass %):

1 to 6% Si 1 to 8% Al with (Al+Si)≦12%, 10 to 30% Mn, remainder iron.

2. The components of claim 1 made from an alloy consisting of (in mass %):

2.0 to 4.0% Si, 2.0 to 4.0% Al, 24 to 26% Mn, remainder iron.

3. The components of claim 2 having a chemical composition (in mass %) of 3% of each of Al and Si, and 25% Mn, remainder iron.

4. Hot rolled or cold rolled sheets for containers or pipe lines used in the field of cryogenics made from an easily deep-drawable austenitic lightweight construction steel with an ultimate tensile strength of 1100 MPa and with TRIP and TWIP characteristics, made from an alloy consisting of (in mass %):

1 to 6% Si 1 to 8% Al with (Al+Si)≦12%, 10 to 30% Mn, remainder iron.

5. The components of claim 4 made from an alloy consisting of (in mass %):

2.0 to 4.0% Si, 2.0 to 4.0% Al, 24 to 26% Mn, remainder iron.

6. The components of claim 5 having a chemical composition (in mass %) of 3% of each of Al and Si, and 25% Mn, remainder iron.

* * * * *